US009646784B2

(12) United States Patent
Ignatov et al.

(10) Patent No.: US 9,646,784 B2
(45) Date of Patent: May 9, 2017

(54) ARC CHAMBER FOR A CONTACTOR AND CONTACTOR TO EXTINGUISH ELECTRIC ARCS

(71) Applicant: Schaltbau Gmbh, Munich (DE)

(72) Inventors: Andrej Ignatov, Munich (DE); Korbinian Kreuzpointner, Schwaig (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 15/110,080

(22) PCT Filed: Jun. 6, 2014

(86) PCT No.: PCT/EP2014/001554

§ 371 (c)(1),
(2) Date: Jul. 6, 2016

(87) PCT Pub. No.: WO2015/127948

PCT Pub. Date: Sep. 3, 2015

(65) Prior Publication Data

US 2016/0329177 A1 Nov. 10, 2016

(30) Foreign Application Priority Data

Feb. 27, 2014 (DE) ..... 10 2014 002 902

(51) Int. Cl.
*H01H 33/18* (2006.01)
*H01H 9/34* (2006.01)
(Continued)

(52) U.S. Cl.
CPC ..... *H01H 33/182* (2013.01); *H01H 9/342* (2013.01); *H01H 9/346* (2013.01); *H01H 9/443* (2013.01); *H01H 33/08* (2013.01)

(58) Field of Classification Search
CPC ..... H01H 50/546; H01H 9/443; H01H 2050/025; H01H 50/54; H01H 50/02;
(Continued)

(56) References Cited

U.S. PATENT DOCUMENTS 5,416,455 A 5/1995 Moldovan et al.
5,763,847 A * 6/1998 Moldovan ..... H01H 9/36 218/149
(Continued)

FOREIGN PATENT DOCUMENTS

DE 1 640 265 A 8/1970
DE 4333278 A1 3/1995
(Continued)

OTHER PUBLICATIONS

German Office Action of Dec. 9, 2014 of corresponding German Patent Application 10 2014 002 902.6; (5 pages).

*Primary Examiner* — Truc Nguyen
(74) *Attorney, Agent, or Firm* — Kilpatrick Townsend & Stockton LLP

(57) ABSTRACT

The present invention relates to an arc chamber to extinguish electric arcs for a contactor with an extinguishing system, a blowing device which blows electric arcs into the extinguishing system, and a plurality of lamellar electric arc extinguishing elements between which flow channels are formed, wherein the flow channels each have a scattering section and wherein the scattering sections of adjacent flow channels are formed with different inclinations so that the blown air is deflected into different directions by the flow channels. The invention further relates to a contactor with such an arc chamber.

18 Claims, 6 Drawing Sheets

Figure 1:
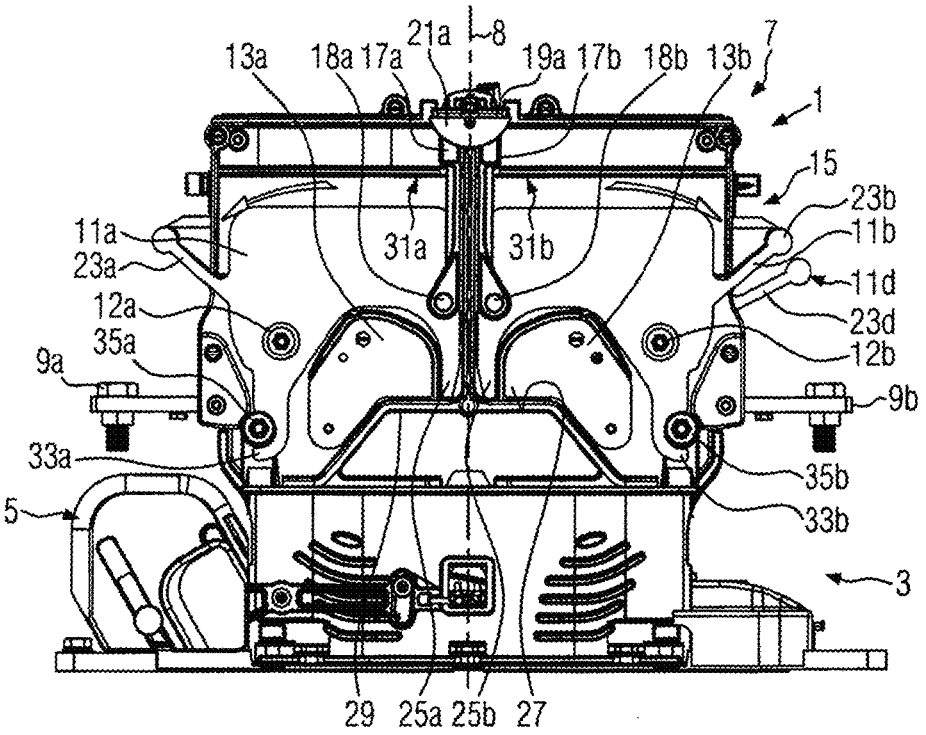

(51) Int. Cl.
*H01H 9/44* (2006.01)
*H01H 33/08* (2006.01)

(58) Field of Classification Search
CPC .... H01H 51/065; H01H 50/14; H01H 50/305; H01H 1/20; H01H 50/023; H01H 50/04; H01H 50/20; H01H 9/34; H01H 9/40; H01H 1/06
See application file for complete search history.

(56) References Cited

U.S. PATENT DOCUMENTS 5,899,323 A * 5/1999 Rakus ..... H01H 1/226 200/244
6,144,273 A * 11/2000 Satoh ..... F16H 59/105 200/11 R
6,194,984 B1 * 2/2001 Kappel ..... H01H 50/546 218/152
6,229,419 B1 * 5/2001 Gundy ..... H01H 71/025 200/293
6,573,815 B1 * 6/2003 Tsukima ..... H01H 9/342 218/22
6,977,354 B1 * 12/2005 Shea ..... H01H 9/342 218/157
7,105,764 B2 * 9/2006 Rakus ..... H01H 9/46 218/146
7,176,771 B2 * 2/2007 Faber ..... H01H 9/342 335/201
7,674,996 B2 * 3/2010 Shea ..... H01H 9/302 218/149
8,164,018 B2 * 4/2012 Yang ..... H01H 9/346 200/401
2005/0012578 A1 * 1/2005 Afshari ..... H01H 9/342 335/202
2006/0213873 A1 9/2006 Shea
2008/0074217 A1 * 3/2008 Duchrow ..... H01H 9/342 335/202

FOREIGN PATENT DOCUMENTS

DE 10 2005 023 163 A1 11/2006
EP 2 230 678 A2 9/2010
WO 93/13538 A1 7/1993

* cited by examiner

ARC CHAMBER FOR A CONTACTOR AND CONTACTOR TO EXTINGUISH ELECTRIC ARCS

This application is a U.S. National Phase of International Application No. PCT/EP2014/001554, filed Jun. 6, 2014, which claims priority to German Patent Application No. 10 2014 002 902.6, filed Feb. 27, 2014, the disclosures of which are incorporated by reference herein.

The invention relates to an arc chamber to extinguish electric arcs for a contactor with an extinguishing system, a blowing device which blows electric arcs into the extinguishing system, and a plurality of lamellar electric arc extinguishing elements between which flow channels are formed, wherein the flow channels each comprise a scattering section.

Contactors with such arc chambers are used for example in railway operations to switch loads and to interrupt electric circuits with large currents and high voltages. In the switching process, i.e. during opening of contact areas, an electric arc is formed at the contact areas. The current flow between contacts is maintained due to this electric arc. In addition, a large amount of heat is released by this electric arc, whereby the contacts are burnt down which can lead to a reduced lifespan of the contactor. Furthermore, the entire device area that is influenced by the effect of the electric arc is exposed to a very strong thermal stress. Therefore, an arc chamber is used which leads to a fast breakdown of the electric arc.

Especially for AC and DC operation, the accumulation of electrically conductive plasma in the extinguishing system, which leads to an unfavorable switching behavior of the contactor, should be avoided. Consequently, the plasma is blown with the electric arcs by the blowing device in the direction of the extinguishing unit and the plasma is released to the environment via flow channels.

An extinguishing chamber of the generic kind is for instance known from WO 93/13538 A1.

In the known arc chamber, the flow channels are formed identically and in parallel to each other so that the outflowing plasma accumulates in the area at the output apertures of the flow channels so that it can lead to thermal stress of the arc chamber and, if appropriate, entail the risk of an electric arc escaping from the arc chamber.

Hence, it is an objective of the present invention to provide an arc chamber for a contactor, which has a long lifespan and which ensures increased safety.

According to the invention, the scattering sections of adjacent flow channels are formed with different inclinations so that the emerging plasma is deflected in different directions by the flow channels. Especially the average temperature at the ends of the flow channels that face away from the contact area is significantly reduced so that a plasma concentration is prevented and the thermal stress is reduced.

The extinguishing system can in particular comprise one or several electric arc guiding plates that guide the electric arc from contact areas into the extinguishing system on opening of the contactor. Preferably, two electric arc guiding plates, which form a V-shape, are arranged. Preferably, at least one contact area with a fixed contact is arranged in the arc chamber. The blowing device preferably creates a magnetic blowout field that blows electric arcs into the extinguishing system. This is preferably achieved by the blowing device having at least one permanent magnet arranged adjacent to the contact areato create a permanent magnetic blowout field, and/or having at least one coil arranged adjacent to the contact area to create an electromagnetic blowout field. The blowout field can further be amplified by magnetically conductive pole plates that are preferably arranged in pairs parallel to each other with an intermediate arrangement of the extinguishing system. Preferably the contact area is also arranged between the pole plates so that a substantially homogeneous magnetic blowout field is formed in the area around the contact area, i.e. the switching area. The fixed contact and/or the electric arc guiding plate are preferably arranged in a way that emerging electric arcs are aligned substantially perpendicular to the magnetic blowout field so that the acting Lorenz force is maximized. Preferably, the flow channels are aligned substantially in the blowing direction so that the emerging plasma can be blown into the flow channels with a low resistance.

Moreover, the arc chamber can be both integrated in the contactor as one part or be formed as a removable part of the contactor.

According to a second aspect of the present invention, the flow channels extend in opposite directions. Thereby, several scattering sections extend preferably with an inclination angle in relation to the blowing direction while other scattering sections extend in an inclined way by the same angle but in an opposite direction and on the same plane in relation to the blowing direction. This arrangement is particularly advantageous when several elongated arc chambers are arranged next to each other, wherein the plasma exits the respective arc chambers in their transversal direction. As several arc chambers are arranged next to each other and hence several contactors are usually not opened simultaneously, the space above the scattering sections of different arc chambers is optimally used for cooling.

According to a third aspect of the present invention, the extinguishing system includes several electric arc extinguishing elements that are arranged next to each other so that at least one flow channel is formed between two adjacent electric arc extinguishing elements. Preferably a respective flow channel is formed between all adjacent electric arc extinguishing elements. The electric arc extinguishing elements can be made preferably of ceramics so that one of their ends can respectively be exposed towards the outside. Hence, the electric arc extinguishing elements do not have to be protected by an additional electrically insulating cover towards the outside so that the cooling of the electric arc extinguishing elements is further improved. The flow channels can, but do not have to, comprise respectively one extinguishing section which is formed in an upstream position in relation to the blowing direction and which forms a part of the extinguishing system.

According to a fourth aspect of the present invention and for the purpose of cost savings, the electric arc extinguishing elements are formed identically, wherein respectively two consecutive electric arc extinguishing elements are arranged in a way as to be turned towards each other by 180 degrees, wherein the electric arc extinguishing elements each include at least one first air-deflecting recess at a first side area and at least one second air-deflecting recess at a second side area that is located opposite to the first side area.

Thereby, the first and the second recesses are inclined relative to the blowing direction and aligned relative to each other so that the first recesses respectively form a scattering section with the adjacent second recesses, wherein each of the scattering sections deflects the air differently.

According to a fifth aspect of the present invention, the flow channels each have a change in cross-section that separates the extinguishing section from the scattering section. This prevents the plasma from leaving the arc chamber with a too high speed without being cooled down by the scattering section.

According to an ancillary aspect, the invention further relates to an arc chamber for a contactor, wherein the arc chamber comprises at least one contact area with a fixed contact, at least one extinguishing system and a blowing device to create a magnetic blowout field which blows electric arcs into the extinguishing system, wherein the blowing device includes at least one permanent magnet, which is arranged adjacent to the contact area, to create a permanent magnetic blowout filed and/or at least one coil, which is arranged adjacent to the contact area, to create an electromagnetic blowout filed so that an electric arc, that emerges on opening of the contact area, is blown into the at least one extinguishing system, wherein at least two magnetically conductive pole plates are arranged in parallel to each other with intermediate arrangement of the permanent magnet and/or the coil so that the blowing effect is achieved by magnetic fields for guiding the electric arcs in the area that is provided for this purpose.

Such an arc chamber is known from the state of the art, for example from the EP 2 230 678 A2. An arc chamber contains wear parts that must be frequently checked and, if necessary, replaced. Further, such an arc chamber with a permanent magnet and/or a coil is very heavy and therefore needs to be firmly connected to a base part in a mechanical way.

Therefore, an objective of the present invention is to provide an arc chamber which can be easily removed and at the same time fastened well to the base part of a contactor.

The problem is solved by at least one of the pole plates being formed as a swivelable locking system by means of which the arc chamber is removable from a base part of a contactor in an unlocked state and connectable to the base part of the contactor in a form-locking way in a locked state. Preferably, the swivelable pole plate includes a hook or a protrusion on the side that faces the base part while the base part respectively includes a corresponding bolt or a recess. In particular, the arc chamber can include an insulating enclosure wherein the pole plate is arranged outside of the enclosure so that the pole plate is coupled magnetically but not electrically with the energized parts in the enclosure. Due to the size and the stability of the pole plates, the strength of the locking system is ensured without any additional parts.

According to a seventh aspect of the present invention, a locking lever is eccentrically swivelable connected to the swivelable pole plate and supported by a holder in a way that a swivel movement of the pole plate leads to a translational movement of the locking lever. The swivel axis of the pole plate thereby is spaced apart from the swivel axis of the locking lever and hence provided eccentrically.

According to an eighth aspect of the present invention, the locking lever is swivelable connected to the pole plate at an end and supported on the opposite, free end by the holder, which comprises a movable safety locking device that in the locked state of the pole plate is pressed into a locked position over the free end by a spring element so that the translational movement of the locking lever and hence also the swivel movement of the pole plate is prevented by the safety locking device. The holder can preferably be formed at one half of the enclosure and be formed in one piece with the latter. The free end is preferably the one end that faces away from the blowing device so that the movable safety locking device is easily accessible from the side of the arc chamber that faces away from the base part.

According to a ninth aspect of the present invention, a display element arranged on the locking lever is visible in the unlocked state and not visible in the locked state. Preferably, the free end of the locking lever is correspondingly marked in color and covered in a locked state, due to the movable safety locking device, and hence not visible.

According to a tenth aspect of the present invention, the swivel movement of the swivelable pole plate is limited in both directions by a respective stop surface. This ensures that the swivelable pole plate will not come in undesired contact with other parts during assembly or an inspection.

According to an eleventh aspect of the present invention, the blowing device comprises at least one coil with a swivelable first pole plate as well as at least one permanent magnet with a non-rotatable second pole plate wherein the first and the second pole plate are separated from each other by an intermediate gap and mounted in one plane. Preferably, the pole plates are correspondingly arranged in pairs and in a way that the coil is arranged between two swivelable pole plates and that the permanent magnet is arranged between two non-rotatable pole plates.

According to a twelfth aspect of the present invention, a stop surface is formed by the enclosure of the arc chamber.

According to another ancillary aspect of the present invention, the invention further relates to an arc chamber for a contactor which comprises at least one contact area with a fixed contact, an extinguishing system and a blowing device that blows electric arcs into the extinguishing system.

At the time of filing, skilled persons have the prejudice that mechanical contactors, in contrast to semiconductor contactors, would not need a heat-dissipating cooling element. The thermal situation of mechanical contactors is usually kept at a certain level by indicating, for example, low power limits or by overdimensioning contact plates. The inventors, however, have surprisingly found that a higher effective power of a conductor can be achieved without much effort by installing a cooling element, which is connected to the fixed contact in a thermally conductive way, on the arc chamber that has been known so far. The fixed contact is particularly plate-shaped and hence has a large contact surface in the switching area close to the contact area. Consequently, cooling of the switching area can be achieved by the cooling element with particular efficiency.

According to a fourteenth aspect of the present invention, the arc chamber further includes an electrically insulating enclosure, wherein the fixed contact extends through the enclosure and consequently forms an electric contact at which the cooling element is mounted.

According to another ancillary aspect of the present invention, the invention further relates to an arc chamber for a contactor comprising at least one contact area with a fixed contact, an extinguishing system with an electric arc guiding plate, wherein an air gap is provided in the proximity of the contact area between the electric arc guiding plate and the fixed contact, and a blowing device to create a magnetic blowout filed which blows electric arcs into the extinguishing system wherein the blowing device comprises at least one permanent magnet, which is arranged adjacent to the contact area, to create a permanent magnetic blowout filed and/or at least one coil, which is arranged adjacent to the contact area, to create an electromagnetic blowout field, so that an electric arc that emerges on opening of the contact area is blown into the at least one extinguishing system wherein a protective cladding is arranged between the air gap and the permanent magnet and/or the coil and extends from the fixed contact towards the electric arc guiding plate.

Such an arc chamber is known for example from the EP 2 230 678 A2 which discloses a protective cladding that is glued to the enclosure.

Therefore, an objective of the present invention is also to provide an arc chamber, wherein the protective cladding is safely fastened and easily replaceable.

The problem is solved by the protective cladding being insertable in the direction of the extinguishing system and hence replacably arranged. In particular, the protective cladding should preferably be insertable under the electric arc conductor piece from below and in the direction of the extinguishing system.

According to a sixteenth aspect of the present invention, the protective cladding is fastened by means of a groove or a protrusion, wherein such groove or protrusion extends perpendicularly to the surfaces of the fixed contact. The arc chamber can further include an enclosure which includes internal delimitation walls, which are provided perpendicularly to the side walls of the enclosure, for receiving the permanent magnet or the coil. Preferably, the protective cladding is attached to such internal delimitation walls through the groove or the protrusion and limited in the direction of the magnetic blowout filed or in the direction of the central axis of the coil or of the north-south direction of the permanent magnet by the side walls of the enclosure.

Preferably, ceramics, e.g. steatite or cordierite, will be used as a material for the protective cladding and/or the electric arc extinguishing elements to enable a simple design and good protection against damages caused bye electric arcs.

According to another ancillary aspect of the present invention, the invention also relates to a contactor for a direct current and/or alternating current operation with at least one movable contact wherein the contactor further includes an arc chamber according to one of the abovementioned aspects.

According to an eighteenth aspect of the present invention, the contactor includes a base part with a locking mechanism which interacts with the swivelable pole plate so that the arc chamber is lockable and unlockable with the base part.

Different design variants can be combined with each other completely or in relation to other characteristics; a design variant can also be complemented by other described characteristics.

Figure 2:
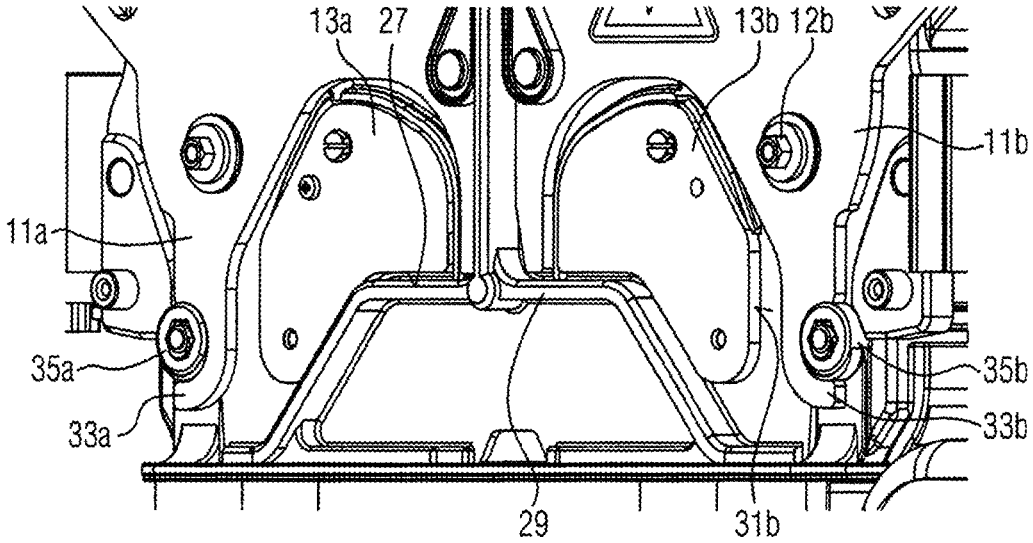
Figure 3:
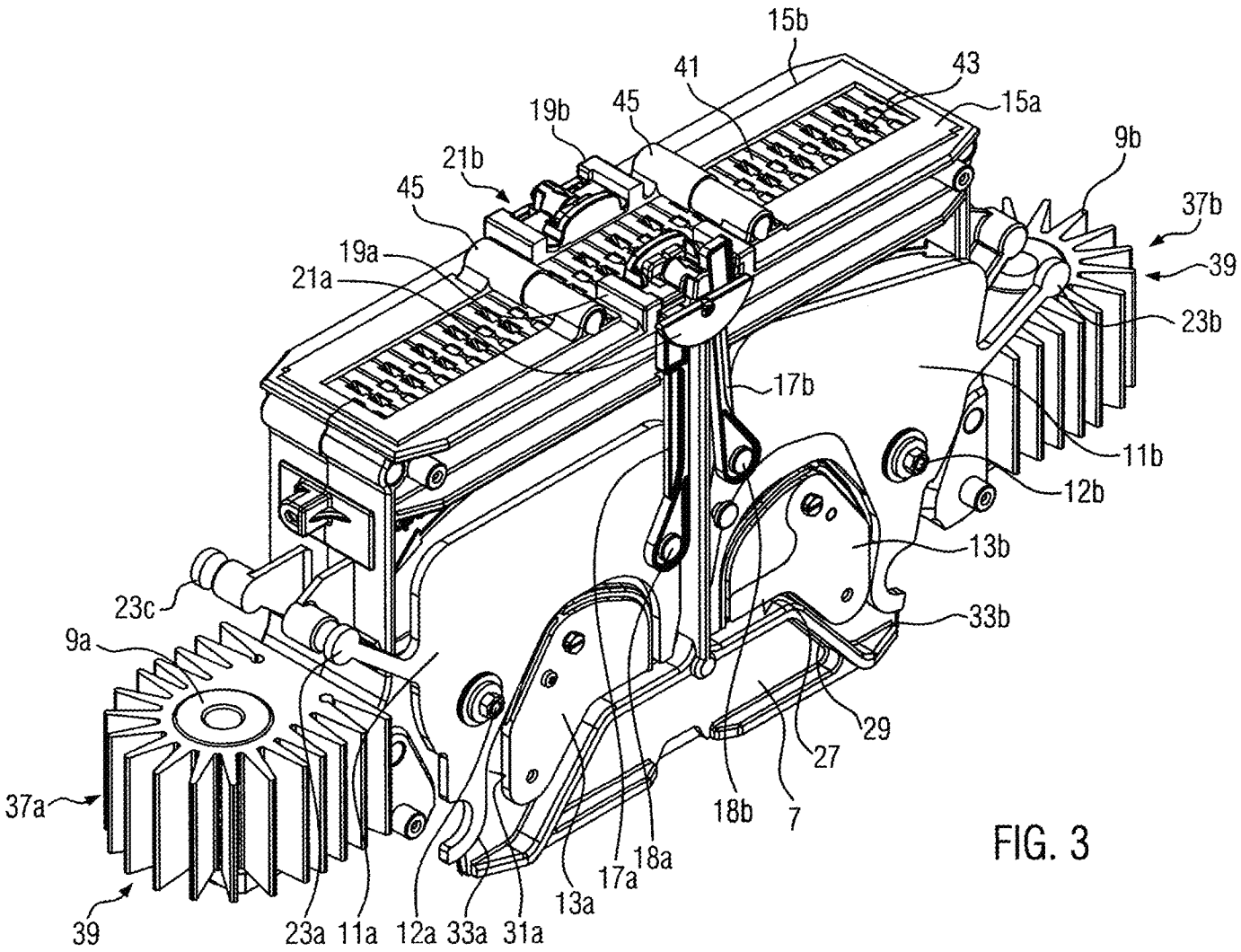
Figure 4:
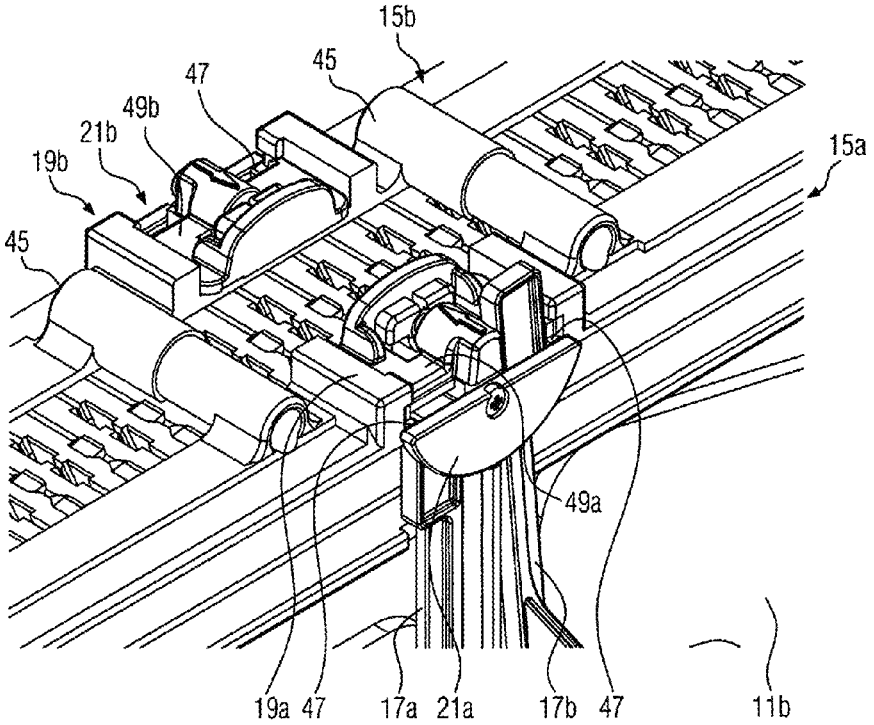
Figure 5:
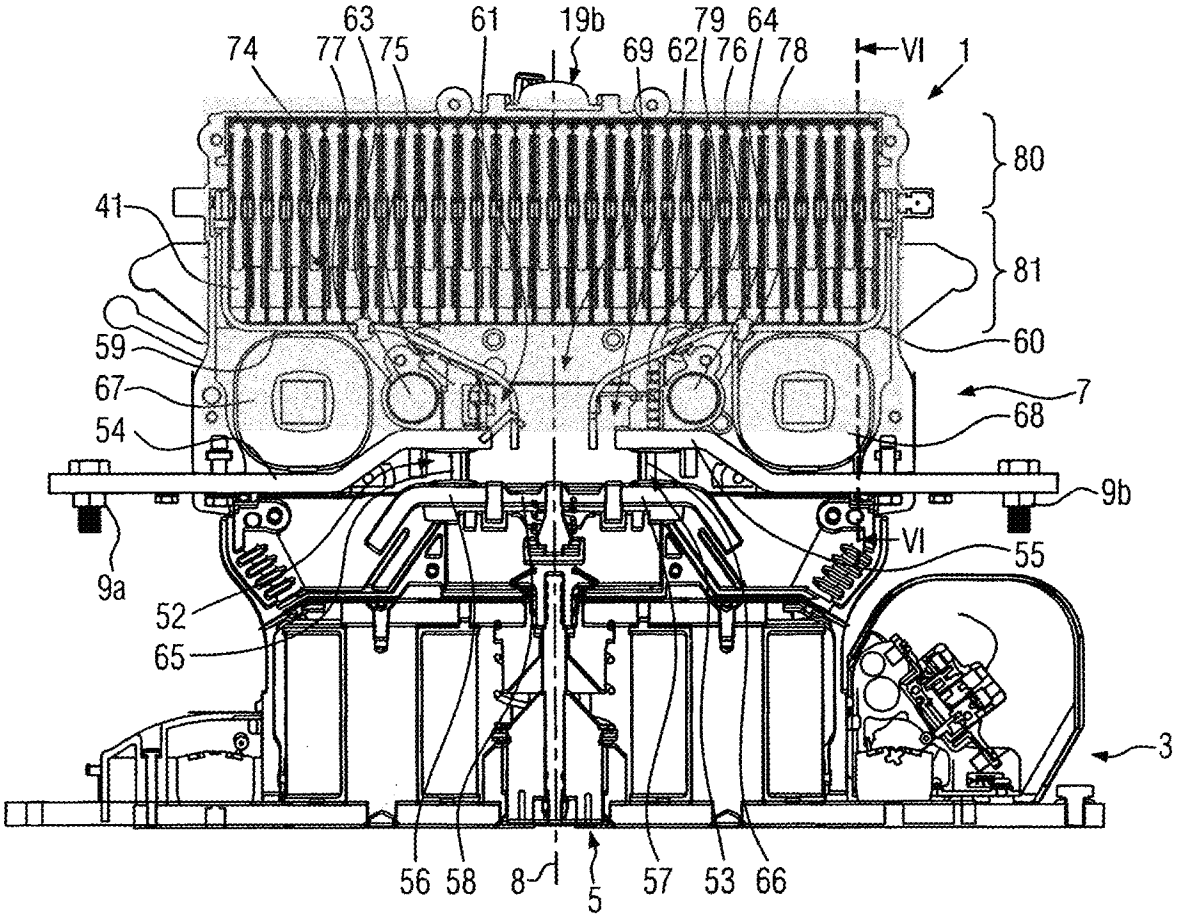
Figure 6:
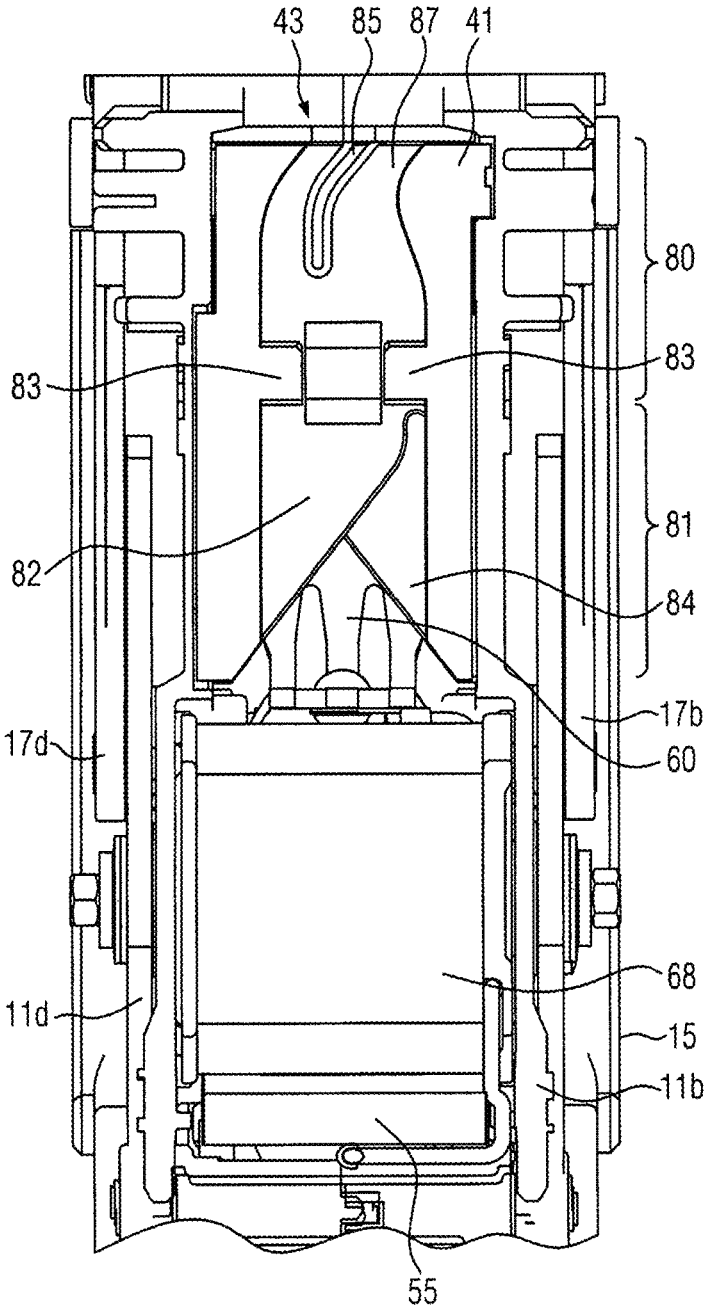
Figure 7:
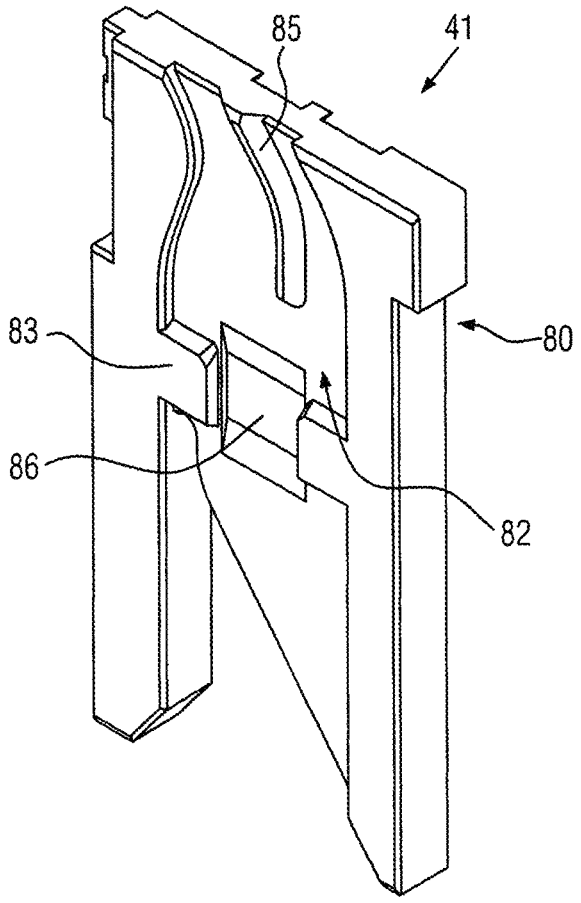

In the following, the invention will be explained in greater detail by means of the drawings. The drawings show:

FIG. 1 front view of a contactor with an arc chamber and a base part in the locked state acc. to a first embodiment, FIG. 2 enlarged display of the locking mechanism, FIG. 3 perspective view of an arc chamber acc. to a second embodiment with two cooling elements, FIG. 4 perspective section view with two movable safety locking devices, FIG. 5 sectional view of a contactor acc. to the first embodiment, FIG. 6 enlarged display of the details VI from FIG. 5, and FIG. 7 enlarged perspective section view of an electric arc extinguishing element with a scattering section.

FIG. 1 shows a front view of a contactor 1. The contactor 1 comprises a base part 3 with a drive 5 to drive movable contacts that are not shown in FIG. 1. An arc chamber 7 is arranged on and connected in a form-locking way to the base part 3. The arc chamber 7 is constructed in a substantially mirror-symmetric way around a central axis 8 with two electric contacts 9*a*, 9*b*. Further, the arc chamber is also constructed in a planar symmetric way so that the displayed front side is identical to the rear of the arc chamber 7 which is not shown. The arc chamber 7 further has four swivelable pole plates 11 and four fixed pole plates 13 that are arranged on an enclosure 15 of the arc chamber in pairs on the front and the rear. In this respect, only two swivelable and two fixed pole plates 11*a, b*, 13*a, b* are shown.

On the upper side that faces away from the base part 3, also a holder 19*a* is formed that extends through the enclosure 15 of the arc chamber 7, wherein two locking levers 17*a, b* are supported by the holder 19*a* between a semicircular support plate 21*a* and the enclosure 15 in a way that a translational movement of the locking levers 17*a, b* alongside their longitudinal axis is enabled. On the ends that face away from the holder 19*a*, the locking levers 17*a, b* are each swivelable supported around a swivel axis 18*a, b* on the respective swivelable pole plates 11*a*, 11*b*. The swivel axes 18*a, b* of the locking levers 17*a, b* are arranged in the proximity of the central axis 8 while the swivel axes 12*a, b* of the swivelalbe pole plates 11*a, b* are respectively arranged spaced apart from the central axis 8. Each swivelable pole plate 11*a, b* has a laterally extending operating lever 23 *a, b* which is provided above the respective electric contact 9*a, b* so that the swivelalbe pole plates 11*a, b* can be operated more easily by the operating levers 23*a, b*. Hence, swivel movements of the left swivelalbe pole plate 11*a* in clockwise direction or the right swivelable pole plate 11*b* in a counterclockwise direction are limited. In the respective opposite direction, the swivel movement comes to a halt on the enclosure due to second stop surfaces 31*a, b* (see FIG. 1). On the sides that face away from the second stop surfaces 31, a respective hook 33*a, b* is formed at each swivelable pole plate 11*a, b*. In the locked state shown in FIG. 1, respectively one bolt 35*a, b* of the base part 3 engages with one of the hooks 33*a, b* so that the arc chamber 7 is not removable from the base part 3 and connected to the base part in a form-locking way.

FIG. 2 shows an enlarged view of the locking mechanism, substantially consisting of the hooks 33*a, b* and the bolts 35*a, b*.

FIG. 3 shows an arc chamber 7 according to a second embodiment, wherein the chamber 7 differs from an arc chamber according to the first embodiment as illustrated in FIGS. 1 and 2 essentially due to two cooling elements 37*a, b* provided at the electric contacts 9*a, b*. In FIG. 3, such parts, that have an identical or similar function as in the first embodiment, are identified with identical reference signs so that the above description relating to FIGS. 1 and 2 is also valid for the second embodiment.

The cooling elements 37*a, b* have each a series of cooling ribs 39 that are arranged alongside the circumferential direction of the cooling elements 37*a, b*. A bolt formed as an electric contact is respectively received in a central borehole of the cooling elements 37*a, b* so that the plane of the contacts is elevated by the thickness of the cooling elements 37*a, b*. On the not depicted underside of the cooling elements 37*a, b*, the bolts formed as electric contacts 9*a, b* are respectively attached to a contact plate that is formed as a fixed contact and that extends through the enclosure 15. The electric contacts 9*a, b* as well as the fixed contacts are cooled efficiently by the cooling elements 37*a, b*.

On the upper side of the enclosure 15 that faces away from the base part, an elongated, square-shaped free surface is provided so that the lamellar electric arc extinguishing elements 41 are exposed at the top. Several outlet apertures 43 of flow channels, which are formed respectively between two adjacent electric arc extinguishing elements 41, are displayed.

The enclosure 15 consists of two enclosure halves 15*a, b* that are connected to each other through connector bolts 45 with respectively one internal borehole. On the top side of the enclosure 15, two holders 19*a, b* with respectively one support plate 21*a, b*, which are explained in greater detail with reference to FIG. 4, are provided.

As shown in FIG. 4, each holder 19*a, b* initially comprises a semicircular support plate 21*a, b* that is fastened to the enclosure 15 by means of a screw and through intermediate arrangement of the free ends of the locking levers 17*a, b*. The support plate 21*a, b* is formed with two lateral lugs 47 in a way that the locking levers 17*a, b* are limited in movement in the circumferential direction and that they are substantially freely moveable along their longitudinal axis. In an unlocked state of the swivelable pole plate 11*b*, the free end of the corresponding locking lever 17*b* extends beyond the upper edge of the enclosure 15 so that the user can determine the state very easily due to the specific color marking of the locking levers 17*a, b*. In a locked state, the locking levers 17*a, b* extend only up to the upper edge of the support plate 21*a, b*. In this case, a movable safety locking device 49*a, b* is pushed into a locked position, i.e. from the position as shown in FIG. 4 in the direction towards the support plate 21*a, b*, by a spring element that is not shown, so that the movable safety locking device 49*a, b* covers the free ends of the locking levers 17*a, b*. Hence, an undesired translational movement of the locking lever 17*a, b* is prevented by the safety locking device 49*a, b*.

FIG. 5 shows a sectional front view of the inside of a contactor 1 according to the first embodiment. However, the following explanations also apply for the second embodiment. The contactor 1 comprises two contact areas 52, 53 with a respective fixed contact 54, 55 and a respective movable contact 56, 57. The movable contacts 56, 57 of the two contact areas 52, 53 are arranged on a common contact bridge 58. The contact bridge 58 can be moved by a magnetic drive and transferred from a closing state of the contactor 1 in which the movable contacts 56, 57 touch the fixed contacts 54, 55 and hence in which the contact areas 52, 53 are closed into an open position. In the open position, the movable contacts 56, 57 are spaced apart from the fixed contacts 54, 55. Due to the high currents and high voltages that are switched with the contactor, electric arcs 65, 66 emerge between the respective fixed contacts 54, 55 and the associated movable contact 56, 57 on opening of the contact areas 52, 53.

An electric arc guiding plate 59, 60 is arranged adjacent to the fixed contacts 54, 55 at each contact area 52, 53, wherein the electric arc guiding plates 59, 60 are insulated from the respective fixed contact 54, 55 by a respective air gap 61, 62. The electric arc guiding plates 59, 60 are shaped in a way as to form an electric arc conductor pit 69 between the contact areas 52, 53 which is substantially perpendicular to the longitudinal extension of the contact bridge 58 and through which the electric arcs 65 or 66 (depending on the movement direction of the electric arc) are blown in the direction of an extinguishing unit 74 by means of the blowout fields of the permanent magnets 63, 64 and/or blowing coils 67, 68.

The blowing coils 67, 68 are arranged substantially between the swivelable pole plates 11*a, b*, while the permanent magnets 63, 64 are arranged substantially between the fixed pole plates 13*a*, 13*b*. The pole plates 11*a, b*, 13*a, b* are not displayed in FIG. 5. Hence, respectively a homogeneous blowout filed is created which blows the electric arcs 65, 66 efficiently into the extinguishing system 74.

On each of the two contact areas 52, 53, a protective cladding 75, 76 is arranged next to the air gap 61, 62. The protective claddings 75, 76 are arranged respectively between the air gap 61, 62, the permanent magnets 63, 64, the fixed contacts 54, 55 and the electric arc guiding plates 59, 60 and extend from the respective fixed contacts 54, 55 upwards to the respective electric arc guiding plates 59, 60. Therefore, a closed space is formed by the protective claddings 75, 76, the fixed contacts 54, 55 and the respective electric arc guiding plates 59, 60 so that the permanent magnets 63, 64 and the blowing coils 67, 68 are protected against electric arcs and the emerging plasma when electric arcs 65, 66 enter the closed space on activation of the blowing coils 67, 68. To fasten the protective claddings 75, 76, it is provided that each of the two cylindrical slots 77, 78 for the permanent magnets 63, 64 that extend through the enclosure are supposed to have a protrusion which extends in the direction of the magnetic blowout filed or the north-south direction of the permanent magnets 63, 64. The protective claddings 75, 76 each have a groove 79 through which the protective claddings 75, 76 are retained in the slots 77, 78. Hence, the protective claddings 75, 76 are also insertable in the direction of the extinguishing system and replacably arranged.

The protective claddings 75, 76 are made of a material that is resistant to electric arcs. Preferably, a ceramic material, especially steatite or cordierite is used for this purpose. These materials have a certain porosity so that they are relatively stable even in case of temperature shocks. This is necessary especially because the electric arc temperature has values up to 20000 K.

A plurality of electric arc extinguishing elements 41 is arranged in a lamellar shape in the extinguishing system 74 above the electric arc guiding plates 59, 60. Between the electric arc extinguishing elements 41, flow channels are formed which need to be further explained and which extend from the electric arc guiding plates 59, 60 in a substantially vertical upward direction. Hence, the air and possibly the plasma, which emerge between the contacts 54, 55, 56, 57 as well as between the electric arc guiding plates 59, 60, are blown into the flow channels and therefore are cooled by the electric arc extinguishing elements 41.

FIG. 6 shows an enlarged display of the sectional view VI from FIG. 5. The electric arc extinguishing elements 41 and the flow channels 82 are each divided into a scattering section 80 and an extinguishing section 81 wherein the scattering section 80 is respectively separated from the extinguishing section 81 by two separating bars 83. In the extinguishing section, respectively a wedge 84 is provided which tapers from the separating bars 83 in the direction towards the electric arc guiding plates 60. An air-deflecting recess is formed at the side area of the electric arc extinguishing element 41 above the separating bars 83. A second air-deflecting recess is formed on the rear that is not shown, wherein the second recess extends in the opposite direction. The electric arc extinguishing elements 41 are stacked next to each other, wherein respectively two consecutive electric arc extinguishing elements 41 are mounted in a way that they are turned towards each other by 180°. Hence, the electric arc extinguishing elements 41 can be formed identically so that they form two groups of scattering sections 80 with opposite directions. Deflector bars 85 with a curvature are respectively formed in the air-deflecting recesses 87 so that the air can be deflected more efficiently.

FIG. 7 is an enlarged perspective section view of the scattering section 80. At the level of the separating bar 83, a change in cross-section is formed by a recess 86 which is formed between the two separating bars 83. The change in cross-section has the purpose of cooling and deflecting the air or the plasma more efficiently.

The invention claimed is:

1. Arc chamber to extinguish electric arcs for a contactor (1) with an extinguishing system (74), a blowing device (63, 64, 67, 68) which blows electric arcs (65, 66) into the extinguishing system (74), and a plurality of lamellar electric arc extinguishing elements (41) between which flow channels (82) are formed, wherein the flow channels (82) respectively include a scattering section (80), characterized in that the scattering sections (80) of adjacent flow channels (82) are formed with different inclinations so that the blown air is deflected in different directions by the flow channels (82).

2. Arc chamber according to claim 1, characterized in that the flow channels (82) extend into opposite directions.

3. Arc chamber according to claim 1, characterized in that the extinguishing system (74) includes several electric arc extinguishing elements (41) that are arranged next to each other so that at least one flow channel (82) is formed between two adjacent electric arc extinguishing elements (41).

4. Arc chamber according to claim 1, characterized in that the electric arc extinguishing elements (41) are formed identically, wherein two consecutive electric arc extinguishing elements (41) are respectively arranged in a way so that they are turned to each other by 180 degrees wherein the electric arc extinguishing elements (41) each include at least one first air-deflecting recess at a first side area and at least one second air-deflecting recess at a second side area that is located opposite to the first side area, wherein the first recess and the second recess are inclined relative to the blowing direction and aligned relative to each other so that the first recesses form a scattering section (80) with the adjacent second recesses in a way that the scattering sections (80) respectively deflect the air differently.

5. Arc chamber according to one of the claim 1, characterized in that the flow channels (82) each have a change in cross-section that separates an extinguishing section (81) from the scattering section (80).

6. Arc chamber according to claim 1, characterized in that the arc chamber (7) comprises at least one contact area (52, 53) with a fixed contact (54, 55), wherein the blowing device (63, 64, 67, 68) serves to create a magnetic blowout filed which blows electric arcs (65, 66) into the extinguishing system (74), wherein the blowing system (63, 64, 67, 68) includes at least one permanent magnet (63, 64), which is arranged adjacent to the contact area (52, 53), to create a permanent magnetic blowout filed and/or at least one coil (67, 68), which is arranged adjacent to the contact area (52, 53), to create an electromagnetic blowout filed so that an electric arc (65, 66), that emerges on opening of the contact area (52, 53) is blown into the at least one extinguishing system (74), wherein at least two magnetically conductive pole plates (11, 13) are arranged in parallel to each other with intermediate arrangement of the permanent magnet (63, 64) and/or the coil (67, 68) so that the blowing effect is amplified by magnetic fields to guide the electric arcs (65, 66), wherein at least one of the pole plates (11, 13) is formed as a swivelable locking system by means of which the arc chamber (7) is removable from a base part (3) of a contactor (1) in an unlocked state and connectable to the base part (3) of the contactor (1) in a form-locking way in a locked state.

7. Arc chamber according to claim 6, characterized in that a locking lever (17) is eccentrically and pivotally connected to the swivelable pole plate (11) in an and supported by a holder (19) in a way that a swivel movement of the pole plate (11) leads to a translational movement of the locking lever (17).

8. Arc chamber according to claim 7, characterized in that the locking lever (17) is pivotally connected to the pole plate (11) at an end and supported on the opposite, free end by the holder (19) which comprises a movable safety locking device (49) that in the locked state of the pole plate (11) is pressed into a locked position over the free end by a spring element so that the translational movement of the locking lever (17) is prevented by the safety locking device (49).

9. Arc chamber according to claim 8, characterized in that a display element arranged on the locking lever (17) is visible in the unlocked state and not visible in the locked state.

10. Arc chamber according to claim 6, characterized in that the swivel movement of the swivelable pole plate (11) is limited in both directions by a respective stop surface (33 with 35, 31).

11. Arc chamber according to claim 10, characterized in that the blowing device (63, 64, 67, 68) comprises at least one coil (67, 68) with a swivelable first pole plate (11) as well as at least one permanent magnet (63, 64) with a non-rotatable second pole plate (13), wherein the first and the second pole plate (11, 13) are separated from each other by an intermediate gap.

12. Arc chamber according to claim 10, characterized in that a stop surface (33 with 35) is formed by an enclosure.

13. Arc chamber according to claim 1, characterized in that the arc chamber includes at least one contact area (52, 53) with a fixed contact (54, 55), wherein a cooling element (37) of the arc chamber is connected to the fixed contact (54, 55) in a thermally conductive way.

14. Arc chamber according to the claim 13, characterized in that the arc chamber further includes an electrically insulating enclosure (15), wherein the fixed contact (54, 55) extends through the enclosure (15) and consequently forms an electric contact (9) at which the cooling element (37) is mounted.

15. Arc chamber according to claim 1, characterized in that the arc chamber comprises at least one contact area (52, 53) with a fixed contact, wherein the extinguishing system (74) includes an electric arc guiding plate (59, 60), wherein an air gap is provided in the proximity of the contact area (52, 53) between the electric arc guiding plate (59, 60) and the fixed contact (54, 55), and wherein the blowing device (63, 64, 67, 68) serves to create a magnetic blowout filed which blows electric arcs (65, 66) into the extinguishing system (74), wherein the blowing device (63, 64, 67, 68) comprises at least one permanent magnet, which is arranged adjacent to the contact area (52, 53), to create a permanent magnetic blowout filed, and/or at least one coil (67, 78), which is arranged adjacent to the contact area (52, 53), to create an electromagnetic blowout filed, so that an electric arc that emerges on opening of the contact area (52, 53) is blown into the at least one extinguishing system (74), wherein a protective cladding (75, 76) is arranged between the air gap and the permanent magnet (63, 64) and/or the coil (67, 68) and extends from the fixed contact (54, 55) towards the electric arc guiding plate (59, 60), and wherein the protective cladding (75, 76) is insertable in the direction of the extinguishing system (74) and hence replaceably arranged.

16. Arc chamber according to claim 15, characterized in that the protective cladding (75, 76) is fastened by means of a groove (79) or a protrusion which extends perpendicularly to the surfaces of the fixed contact (54, 55) and/or the surface of the electric arc guiding plate (59, 60).

17. Contactor for a direct current and/or alternating current operation with at least one movable contact (56, 57), characterized by an arc chamber (7) according to claim 1.

18. Contactor according to claim 17 with an arc chamber according to claim 6, characterized in that the contactor (1) includes a base part (3) with a locking mechanism that interacts with the swivelable pole plate (11) so that the arc chamber (7) is lockable and unlockable with the base part (3).

* * * * *